United States Patent [19]

Lowry

[11] 4,067,416

[45] Jan. 10, 1978

[54] ELEVATOR SYSTEM

[75] Inventor: James Lowry, Hicksville, N.Y.

[73] Assignee: Westinghouse Electric Corporation, Pittsburgh, Pa.

[21] Appl. No.: 720,724

[22] Filed: Sept. 7, 1976

[51] Int. Cl.[2] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 3,474,886 | 10/1969 | Iordanidis | 187/29 |
| 3,779,346 | 12/1973 | Winkler | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system including terminal slowdown control which includes a source which provides a beam of electromagnetic radiation, a receiver of such radiation, and spaced markers disposed in a terminal zone which interrupts the beam of electromagnetic radiation as the elevator car approaches a terminal floor. A monitor circuit monitors the receiver to insure that the beam is continuously received when the elevator car is outside of the terminal zone, and to insure that the receiver detects the spaced markers as the elevator car approaches a terminal floor in the terminal zone. The monitor circuit initiates a procedure which takes the elevator car out of service in the event a malfunction in the terminal slowdown control is detected.

14 Claims, 1 Drawing Figure

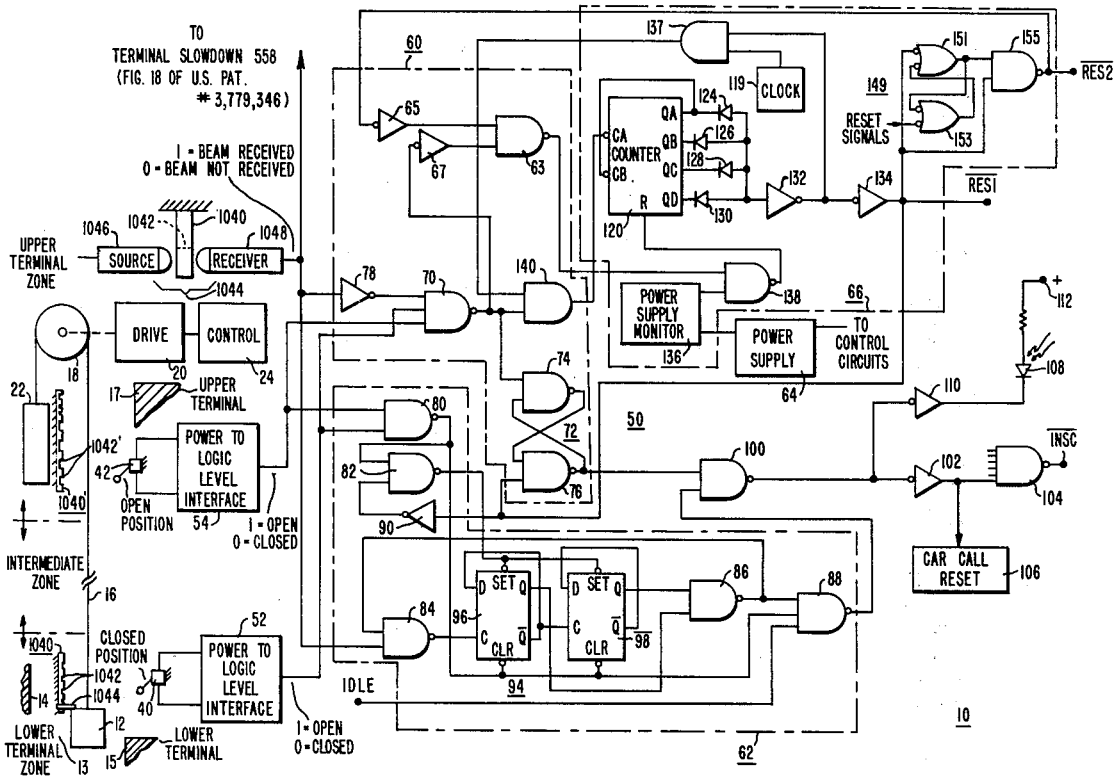

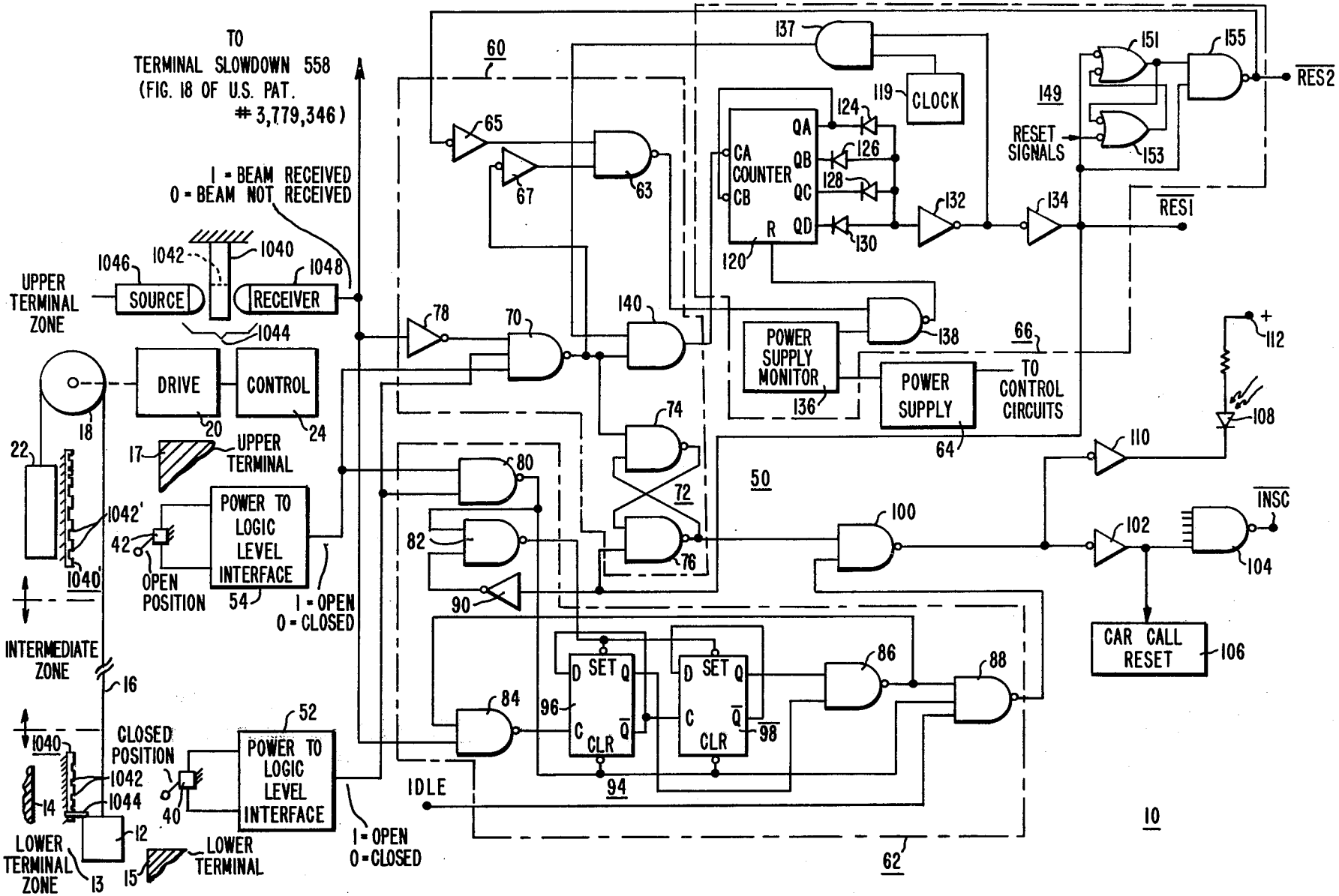
RES2
RES1
RESET SIGNALS
149
151
153
155
CLOCK
119
124
126
128
130
132
134
137
138
COUNTER
QA
QB
QC
QD
CA
CB
R
120
POWER SUPPLY MONITOR
136
POWER SUPPLY
64
66
TO CONTROL CIRCUITS
112
108
110
INSC
104
102
106
CAR CALL RESET
10
50
62
60
63
65
67
70
72
74
76
78
80
82
84
86
88
90
94
96
98
100
140
SET
CLR
D
C
Q
IDLE
1 = OPEN
0 = CLOSED
TO TERMINAL SLOWDOWN 558 (FIG. 18 OF U.S. PAT. # 3,779,346)
1 = BEAM RECEIVED
0 = BEAM NOT RECEIVED
1048
RECEIVER
1040
1042
1044
SOURCE
1046
CONTROL
24
DRIVE
20
UPPER TERMINAL
17
POWER TO LOGIC LEVEL INTERFACE
54
OPEN POSITION
42
1042'
1040'
18
22
UPPER TERMINAL ZONE
16
INTERMEDIATE ZONE
52
POWER TO LOGIC LEVEL INTERFACE
CLOSED POSITION
40
LOWER TERMINAL
15
12
13
14
LOWER TERMINAL ZONE

ELEVATOR SYSTEM

BACKGROUND OF THE INVENTION

1. Field of the Invention

The invention relates in general to elevator systems, and more specifically to new and improved terminal slowdown control for elevator systems.

2. Description of the Prior Art

It is necessary in elevator systems to provide a redundant, independent means for detecting an overspeed condition of an elevator car as it approaches a terminal floor. In addition to the speed monitoring function, once an overspeed condition is detected, means must be provided for safely bringing the car to a stop.

U.S. Pat. No. 3,779,346 entitled "Terminal Slowdown Control for Elevator System", which is assigned to the same assignee as the present application, discloses an improved terminal slowdown control which provides a terminal slowdown signal by interrupting a beam of electromagnetic radiation with spaced markers as the elevator car approaches a terminal floor. The magnitude of this terminal slowdown signal indicates whether or not the elevator car is decelerating properly, and if an overspeed condition is detected, this same terminal slowdown signal is substituted for the normal slowdown pattern signal to decelerate and stop the elevator car at the terminal floor. The terminal slowdown system of U.S. Pat. No. 3,779,346 eliminates the long cams and mechanical switches of the prior art, and is thus easier to install and maintain.

The independent terminal slowdown control provides a terminal slowdown signal each time a terminal floor is approached, but if the normal slowdown and stopping control is functioning properly, and the elevator car is properlyresponding thereto, the operation of the independent terminal slowdown control is not apparent.

SUMMARY OF THE INVENTION

Briefly, the present invention improves the independent terminal slowdown control of U.S. Pat. No. 3,779,346 by providing a monitoring circuit which continuously checks all of the functions of the independent terminal slowdown control. When the elevator car is between the upper and lower terminal zones, with a terminal zone being defined as the location adjacent a terminal floor where the beam of electromagnetic radiation is broken by the spaced markers, the beam of electromagnetic radiation should be continuously received by the receiver or detector of such radiation. Failure of the receiver to continuously detect such electromagnetic radiation when the elevator car is between the terminal zones prevents a stationary car from starting, and stops a moving car at the closest floor at which the car can make a normal stop, and then takes the car out of service.

Proper alignment of the source and receiver of electromagnetic radiation with the spaced markers is checked each time the elevator car traverses a terminal zone by a circuit which detects interruption of the beam by the markers. If the beam of electromagnetic radiation is not interrupted a predetermined number of times as the elevator car traverses a terminal zone, the monitoring circuit will not allow the car to leave the terminal floor, and it takes the car out of service until the malfunction is corrected by service personnel.

BRIEF DESCRIPTION OF THE DRAWING

The invention may be better understood, and further advantages and uses thereof more readily apparent, when considered in view of the following detailed description of an exemplary embodiment, taken with the accompanying drawing, in which the single FIGURE is a schematic diagram of an elevator system constructed according to the teachings of the invention.

DESCRIPTION OF THE PREFERRED EMBODIMENT

Referring now to the drawing, the single FIGURE is a schematic diagram of a new and improved elevator system 10 constructed according to the teachings of the invention. Elevator system 10 includes a car 12 mounted in a hatchway 13 for movement relative to a structure 14 having a plurality of floors or landings, with only the lower and upper terminal floors 15 and 17, respectively, being shown in order to simplify the drawing. The car 12 is supported by a rope 16 which is reeved over a traction sheave 18 mounted on the shaft of a drive motor 20, such as a direct current motor as used in the Ward-Leonard drive system. A counterweight 22 is connected to the other end of the rope 16. The control for operating the drive motor 20, including the motor controller, speed pattern generator, distance slowdown control, and floor selector, is shown generally at 24. The hereinbefore mentioned U.S. Pat. No. 3,779,346 may be referred to for details of such control, and this patent is hereby incorporated into the present application by reference.

The distance slowdown control portion of control 24 provides the normal speed pattern for decelerating and stopping the elevator car 12 at the terminal, and intermediate floors. The redundant and independent terminal slowdown control is provided by a combination of pick-up means and spaced marker means, which are arranged for relative movement as the elevator car approaches a terminal floor. For purposes of example, it will be assumed that the pick-up means is mounted on the elevator car, indicated generally at 1044, and that the spaced marker means is in the form of elongated plates or blades 1040 and 1040' disposed adjacent the lower and upper terminal floors 15 and 17, respectively. The blades 1040 and 1040', in order to function as spaced markers, are provided with notches, holes, or openings 1042 and 1042', respectively.

The notches or openings 1042 are spaced and oriented such that the pick-up means 1044 on the car 12 can detect their presence as the car 12 approaches a terminal floor and initiate pulses which are utilized by a terminal slowdown circuit 558 shown in the incorporated patent.

The openings 1042 of slowdown blade 1040 are spaced such that if the car is slowing down with a constant rate of deceleration, the time elapsed as the car travels from one opening to the next stays constant. If the car is not decelerating, or the deceleration rate of the car is not within acceptable limits, the time between the spaced openings will be shorter than normal and a monitoring circuit in the terminal slowdown circuit 558 will detect this overspeed condition and cause the car to initiate terminal slowdown.

The same blade 1040 used to detect overspeed is used to generate the auxiliary speed pattern when an overspeed condition is detected. The difference between the rate at which the pulses are provided in response to the pick-up means 1044 passing the blade 1040, and a predetermined rate corresponding to the maximum allowable slowdown rate, gives the speed error. The spacing of the openings in the blade 1040 sets the predetermined slowdown rate, with any deviation from the slowdown rate automatically providing an unbalance which is converted to a unidirectional speed error signal. This speed error signal may be used to directly feed the motor controller portion of control 24. Alternatively, the speed error signal may be added to the actual speed of the car, measured by such means as a conventional tachometer, to obtain a speed pattern which may be directly substituted for the normal speed pattern.

Pick-up means 1044 detects the presence of the notches or holes 1042. Pick-up means 1044 may be of any suitable type, such as a photoelectric device which includes a source 1046 of electromagnetic radiation directed towards and spaced from a receiver 1048 of such radiation, with the discontinuities of the blade 1040 passing between the source and receiver when the car is traveling in the hatchway adjacent a terminal floor. The source 1046, for example, may be a light-emitting diode, a glow lamp, a neon lamp, or the like, with a light-emitting diode which provides electromagnetic radiation in the infrared wave length range being preferred. The receiver 1048 may be phototransistor, a photo-diode, a photoresistor, or the like. The pick-up means 1044 alternatively may be of the magnetic type, using proximity detector principles, or transformer principles.

Receiver 1048 includes means for generating pulses as the discontinuities of the blade 1040 and the pick-up means 1044 move relative to one another, which pulses are applied to an input terminal of the terminal slowdown circuit 558.

The present invention monitors the operation of the pick-up means 1044 by insuring that the receiver 1048 continuously receives a beam of electromagnetic radiation from source 1046 when the elevator car is outside the terminal slowdown blades 1040 and 1040', and by insuring that the receiver 1048 provides a predetermined number of pulses when the car 12 approaches either terminal floor adjacent the slowdown blades. The hoistway 13 is divided into zones to indicate: (a) when the elevator car 12 is physically located between the start of a slowdown blade and the associated terminal floor, which location will be called a terminal zone, and (b) when the elevator car 12 is located between the upper and lower terminal zones, which will be called an intermediate zone. For purposes of example, the zones are established by lower and upper hatch switches 40 and 42, respectively, which are fixed in the hatchway 13 adjacent to the start of the blades 1040 and 1040', respectively. A cam on the elevator car 12 operates switch 40 to its closed position as the car approaches the lower terminal floor 15, with the cam being located such that the switch 40 is closed just before the pick-up means 1044 detects the presence of the slowdown blade 1040. The hatch switch 40 then remains closed until just after the pick-up means 1044 clears the slowdown blade 1040 as the car 12 travels upwardly in the hatchway 13 away from the lower terminal floor 15.

In like manner, a cam on the car 12 operates switch 42 to its closed positon as the car 12 approaches the upper terminal floor 17, with the cam being located such that switch 42 is closed just before the pick-up means 1044 detects the slowdown blade 1040'. The hatch switch 42 then remains closed until just after the pick-up means 1044 clears the slowdown blade 1040' as the car 12 travels downwardly in the hatchway 13 away from the upper terminal floor 17.

Thus, when the car 12 is located such that the pick-up means 1044 is between the slowdown blades 1040 and 1040', the car is in an intermediate zone signified by the fact that both switches 40 and 42 are in their open positions. When either switch is closed, it signifies that the elevator car is located within a terminal zone. While mechanical hatch switches 40 and 42 are illustrated in the FIGURE, it is to be understood that they may be of any other suitable type, such as magnetic or inductor switches.

Elevator system 10 also includes monitoring means 50 which is responsive to the output of receiver 1048 and to the position of the hatch switches 40 and 42. Receiver 1048 includes means providing a logic one signal when the electromagnetic beam is received from source 1046, and a logic zero signal when the receiver 1048 is not receiving the beam of electromagnetic radiation.

Switches 40 and 42 include power level to logic level interface circuits 52 and 53, respectively, which translate an open switch position to a logic one signal, and a closed switch position to a logic zero signal.

Monitoring means 50 includes: (a) first means 60 which is responsive to the car position and to the signal from receiver 1048, with the first means initiating a predetermined change in the operation of the elevator car 12 when the elevator car is located in the intermediate zone and the receiver 1048 is providing a logic zero signal, i.e., the electromagnetic beam is not received; and, (b) second means 62 which initiates the predetermined change in the operation of the elevator car 12 when the receiver 1048 fails to switch between its logic one and logic zero levels a predetermined number of times as the elevator car traverses a terminal zone.

On initial start-up of the elevator system 10, i.e., when electrical power, such as the power supply 64, is applied to the various control circuits, a reset circuit 66 provides a low (true) first reset signal $\overline{RES1}$, which initiates a first reset mode, and after a predetermined period of time reset signal $\overline{RES1}$ goes high to initiate a second reset mode and enable the next step in the process of bringing the elevator car into service. The first means 60 of monitoring means 50 inhibits the reset signal $\overline{RES1}$ from going high when the elevator car 12 is located in the intermediate zone and the receiver 1048 is providing a logic zero signal, which indicates that the receiver 1048 is not receiving the beam of electromagnetic radiation. Thus, the elevator car 12 is prevented from becoming an in-service car.

If the elevator car 12 is located within the lower terminal zone when power is first applied to its control circuits, the reset signal $\overline{RES1}$ is not prevented from going to a logic one, and the pick-up means 1044 is not used for terminal slowdown. However, as soon as the elevator car 12 leaves the lower terminal zone, the first means 60 will stop the car at the closest floor and take it out of service, if the receiver 1048 is not receiving the beam of electromagnetic radiation.

If the elevator car is located within the upper terminal zone when power is first applied to its control circuits, the reset signal $\overline{RES1}$ is not prevented from going to a logic one. The elevator car will start down, but as soon as it leaves the upper terminal zone, the first means 60 will immediately stop the car if the receiver 1048 is not receiving a beam of electromagnetic radiation.

More specifically, the first means 60 includes a three input NAND gate 70, a dual input NAND gate 63 an AND gate 140, a memory 72, such as a flip-flop constructed of cross-coupled NAND gates 74 and 76, and inverter or NOT gates 65, 67 and 78. The output of receiver 1048 is connected to one input of NAND gate 70 via inverter 78, and the other two inputs are connected to the hatch switch interface circuits 52 and 54. The output of NAND gate 70 is connected to the set input of memory 72, and the reset input of memory 72 is connected to receive the reset output of reset circuit 66, i.e., the rest signal $\overline{RES1}$. The output of NAND gate 70 is also connected to an input of the AND gate 140, and, via inverter 67, to an input of NAND gate 63. A second reset signal $\overline{RES2}$, which is low during the second reset mode, is connected to the remaining input of NAND gate 63 via inverter 65. The remaining input of AND gate 140 is connected to receive clock pulses from the reset circuit 66, as will be hereinafter explained. The output of NAND gate 63 is connected to the reset circuit 66.

The second means 62 includes NAND gates 80, 82, 84, 86 and 88, inverter 90, and counting means 94 which may include first and second D-type edge-triggered flip-flops 96 and 98, respectively. NAND gate 80 is a dual input device which has its inputs connected to the hatch switch interface circuits 52 and 54. The output of NAND gate 80 is connected to an input of NAND gate 82 and to the clear input CLR of flip-flops 96 and 98. NAND gate 82 is a dual input NAND gate, which has its remaining input connected to the reset output of reset circuit 66 via inverter 90. The output of NAND gate 82 is connected to the set inputs SET of flip-flops 96 and 98.

NAND gate 84 is a dual input NAND gate, with one of its inputs connected to the output of receiver 1048, and the other input connected to the output of NAND gate 86. The output of NAND gate 84 is connected to clock input C of flip-flop 96.

The $\overline{Q}$ output of flip-flop 96 is connected to the clock input C of flip-flop 98 and to its own D input. The $\overline{Q}$ output of flip-flop 96 is connected to an input of NAND gate 86, which is a dual input NAND gate. The $\overline{Q}$ output of flip-flop 98 is connected to the D input of flip-flop 98, and the Q output of flip-flop 98 is connected to the remaining input of NAND gate 86. The output of NAND gate 86 is connected to an input of NAND gate 88, which is a three-input gate. Another input of NAND gate 88 is connected to the output of NAND gate 80, and the remaining input is connected to receive the signal IDLE. Signal IDLE is high or true when the elevator car is idle, ready to make a run.

The output of NAND gate 88 is connected to an input of a dual input NAND gate 100, with the other input of NAND gate 100 being connected to the output of NAND gate 76 of memory 72. Thus, NAND gate 100 is controlled by both the first means 60 and by the second means 62.

The output of NAND gate 100 is utilized to modify the operation of the elevator system 10 when either the first or the second means 60 or 62, respectively, detects a malfunction in the independent terminal slowdown control. Such modification of the elevator system may include taking the elevator car out of service and canceling its car calls. Thus, the output of NAND gate 100 may be connected, via an inverter 102, to one of the many inputs of a NAND gate 104 which provides a low or true in-service signal $\overline{INSC}$ when the elevator car is in service. Any low input to NAND gate 104 takes the elevator car out of service. The output of inverter 102 is also connected to the master car call reset circuit, shown generally at 106.

If the elevator car 12 is taken out of service due to a malfunction of the independent terminal slowdown control, this fact may be continuously signaled by a suitable indicator in the machine or control room, such as by connecting the output of NAND gate 100 to the cathode electrode of a light-emitting diode 108 via an inverter 110. The anode electrode of a light-emitting diode 108 is connected to a source of unidirectional potential, indicated generally by terminal 112.

The normal reset means 66 for the elevator system may include timing means which switches the reset signal $\overline{RES1}$ from logic zero to logic one a predetermined period of time after power is applied to the control circuits. When signal $\overline{RES1}$ goes high and the elevator car is not located at a terminal floor where its selector may be reset, a second reset signal $\overline{RES2}$ will go low which initiates a control sequence which will move the car to the lower terminal floor to reset its floor selector. Reset means 66 includes a clock 119, a 4-bit binary counter 120, such as Texas Instruments 4-bit ripple through counter SN 7493, four diodes 124, 126, 128 and 130, a dual input AND gate 137, a memory 149 which may be constructed of cross-coupled NAND gates 151 and 153, a dual input NAND gate 155, inverters 132 and 134, and a power supply monitor 136. Input CA of counter 120 is connected to the output of AND gate 140 of the first means 60, and input CB of counter 120 is connected to its QA output.

The four outputs QA, QB, QC and QD of counter 120 are connected to the cathode electrodes of diodes 124, 126, 128 and 130, respectively, and the anodes of the diodes are connected to an input of inverter 132. The output of inverter 132 is connected to an input of AND gate 137, to the output terminal $\overline{RES1}$ via an inverter 134, to the set input of memory 149, i.e., an input of NAND gate 151, and to an input of NAND gate 155. The other input of NAND gate 155 is connected to the output of NAND gate 151. The reset input of memory 149, i.e., an input of NAND gate 153, is connected to receive a reset signal when the car is already located at a floor where its selector may be rest, or it is approaching a floor where its selector may be reset and has initiated slowdown. These signals are indicated generally in the FIGURE as "Reset Signals". The output of NAND gate 15 provides the second reset mode when it goes low to provide low signal $\overline{RES2}$. Signal $\overline{RES2}$ is connected to the input of inverter 65 of the first means 60.

The reset input of counter 120 is connected to the output of NAND gate 138. NAND gate 138 has one input connected to the output of power supply monitor 136, which monitors the system power supply 64, and its remaining input is connected to the output of NAND gate 63.

In the operation of the elevator system 10, it will first be assumed that the power supply 64 was turned off, or otherwise failed to supply electrical power to the elevator system 10, with the elevator car 12 being located in the intermediate zone. Thus, hatch switches 40 and 42 will both be in their open positions. When power returns or is turned on, the power supply monitor 136 resets counter 120 to provide zeros at its output terminals, the hatch switch interface circuits 52 and 54 will each apply a logic one to NAND gate 70, and if the receiver 1048 is receiving a beam of electromagnetic radiation from source 1046, inverter 78 will apply a logic zero to NAND gate 70. This logic zero forces NAND gate 70 to output a logic one signal to AND gate 140. AND gate 140 thus transmits the output of clock 119 to input CA of counter 120. As long as any of the outputs of counter 120 are at the logic zero level, output terminal $\overline{RES1}$ will be low, indicating the system is in the reset cycle. When the counter 120 counts 15 pulses, all of its outputs will be high, the output of inverter 132 blocks AND gate 137 from transmitting any further clock signals, and signal $\overline{RES1}$ goes high to enable the elevator car to continue with the procedure which results in the elevator car becoming an in-service car. As hereinbefore stated, the next reset operation is to reset the car's floor selector.

If the receiver 1048 is not receiving a beam of electromagnetic radiation after electrical power is applied to the control circuits, and the elevator car is located in the intermediate zone, inverter 78 will apply a logic one to NAND gate 70, and NAND gate 70 will apply a logic zero to AND gate 140, preventing AND gate 140 from transmitting clock signals. Thus, counter 120 will not advance from its reset condition, signal $\overline{RES1}$ will remain low, and the elevator car 12 will be prevented from becoming an in-service car.

If electrical power is applied to the control circuits when the elevator car is physically located within the lower terminal zone, the associated hatch switch will be closed and NAND gate 70 will thus have a logic zero applied thereto. Thus, the pick-up means 1044 will not be monitored at this time. This is not a disadvantage, however, as the elevator car is already stopped in a terminal zone, probably at the associated terminal floor, and if it must make a run to a terminal floor to reset its selector, it will do so at slow speed without utilizing pick-up means 1044 to stop the car accurately at floor level. As will be hereinafter explained, a defective pick-up means 1042 will be detected the instant the car leaves the terminal zone and enters the intermediate zone, and the car will stop at the closest floor and go out of sevice before being called upon to approach a terminal floor.

If electrical power is applied to the control circuits when the elevator car is physically located within the upper terminal zone, the associated hatch switch 42 will be closed. NAND gate 70 will thus have a logic zero applied thereto and pick-up means 1044 will not be monitored at this time. However, as soon as the elevator car runs to reset its floor selector during the RES2 mode of reset operation, a defective pick-up means 1044 will be detected the instant the car enters the intermediate zone, placing a logic zero at the input of inverter 67. The input to inverter 65 will be a logic zero since $\overline{RES2}$ is low when the car runs to reset its selector and both inputs to NAND gate 63 will be high causing the output of NAND gate 63 to be low. The logic zero at the input of NAND gate 138 forces its output high to reset counter 120 to provide a low signal $\overline{RES1}$. The elevator car will not run in the RES1 mode and it will remain just below the upper terminal zone because counter 120 will not be pulsed, i.e., clock 119 will be inhibited by a logic zero on the input of AND gate 140 from NAND gate 70.

Now it will be assumed that the elevator car 12 has been allowed to become an in-service car, and thus reset signals $\overline{RES1}$ and $\overline{RES2}$ are both high. It will further be assumed that the car 12 is located in the intermediate zone and that the beam of electromagnetic radiation is received by receiver 1048. NAND gate 70 will output a logic one, memory 72 will apply a logic one to NAND gate 100, and the second means 62 will apply a logic one to NAND gate 100, i.e., a logic one from NAND gate 88 is forced by NAND gate 80 with both hatch switches open, indicating that the car is located in the intermediate zone. NAND gate 100 thus applies a logic zero to inverters 102 and 110, NAND gate 104 receives a high signal from inverter 102 and the in-service signal $\overline{INSC}$ remains true or low. The car call reset circuit 106 is unaffected by the logic one, and the light-emitting diode 108 is not turned on.

If the receiver 1048 fails to receive a continuous beam of electromagnetic radiation from source 1046 when the elevator car 12 is located in the intermediate zone, or should the elevator car 12 enter the intermediate zone following start-up with a defective pick-up means 1044, NAND gate 70 will have all logic one signals at its inputs, causing memory 72 to set to provide a logic zero to NAND gate 100. NAND gate 100 thus outputs a logic one signal which forces NAND gate 104 to provide a high signal INSC which initiates the procedure for taking the elevator car 12 out of service, i.e., such as by stopping a moving car at the closest floor at which it may stop according to a predetermined deceleration schedule, opening its doors, canceling its car calls, and turning off its lights; and, by opening the doors of a stationary car, and canceling its car calls. The logic zero resets the car calls via the car call reset circuit 106, and the logic zero output by inverter 110 enables the light-emitting diode 108 to be energized.

If the car 12 is located in the intermediate zone and the beam of electromagnetic radiation is received by receiver 1048, memory 72 will apply a logic one to NAND gate 100. NAND gate 80 provides a logic zero output signal while the car is in the intermediate zone to clear the flip-flops 96 and 98, i.e., cause their Q outputs to be a logic zero, and their $\overline{Q}$ outputs to be a logic one, and to force NAND gate 88 to apply a logic one to NAND gate 100.

Assume now that the elevator car 12 enters a terminal zone, such as the lower terminal zone. Hatch switch 40 closes to force NAND gate 70 high and thus render the first means 60 ineffective while the car 12 is in a terminal zone. NAND gate 80 now outputs a logic one signal with one hatch switch closed, releasing the pulse counter 94 and releasing its block of NAND gate 88. The signal IDLE will be low at this time, and NAND gate 86 will be applying a logic one signal to NAND gate 88.

NAND gate 84 will transmit pulses from receiver 1048. When a predetermined number of pulses is received, i.e., three pulses in the example illustrated in the FIGURE, the Q outputs of flip-flops 96 and 98 will both be at the logic one level and NAND gate 86 will output a logic zero signal to block NAND gate 84 from transmitting any further pulses, and also to force NAND gate 88 to apply a logic one signal to NAND gate 100 and thus maintain normal system operation.

If the receiver 1048 does not provide at least three pulses, NAND gate 86 will not provide a logic zero, i.e., its output will remain at the logic one level. As soon as the elevator car stops and becomes idle, the signal IDLE will go high and the output of NAND gate 88 will switch to a logic zero. This forces the output of NAND gate 100 high, which has the same circuit effect as hereinbefore described when memory 72 caused the output of NAND gate 100 to go high, i.e., the car will be taken out of service, its car calls will be reset, and an indicator will be illuminated to indicate failure of the independent terminal slowdown system.

In summary, there has been disclosed a new and improved elevator system which includes electromagnetic pick-up means and spaced markers which cooperate to provide a redundant, independent terminal slowdown monitor and speed pattern. The independent terminal slowdown apparatus is constantly monitored, according to the teachings of the invention, to insure (a) that the beam is continuously received when the elevator car is in a location where it should be continuously received, and (b) that the pick-up and markers are properly aligned to pulse the beam properly as the terminal floor is approached by the elevator car. Failure to continuously detect a beam in (a), or failure to count a predetermined number of pulses in (b), results in the elevator car being taken out of service. If the elevator car is out of service, and an attempt is made to place it in service when it is located outside of the terminal zones, such an attempt will not be effective unless the receiver is continuously receiving a beam of electromagnetic radiation.

I claim as my invention:

1. An elevator system, comprising:

a structure having a hatchway and a terminal floor, an elevator car mounted for movement in said hatchway, means for detecting overspeed of the elevator car as it approaches said terminal floor in a predetermined terminal zone adjacent thereto, said means including spaced marker means and detector means mounted for relative movement as the elevator car approaches said terminal floor in said terminal zone, said detector means including a source of electromagnetic radiation, and a receiver thereof, mounted such that electromagnetic radiation from the source continuously maintains the receiver in a first condition when the elevator car is outside said terminal zone, and with the spaced marker means disposed to operate said receiver between said first condition and a second condition in response to movement of said elevator car in said terminal zone, and monitoring means responsive to the condition of said receiver, including first means which initiates a predetermined change in the operation of said elevator car when the elevator car is located outside said terminal zone and said receiver is in its second condition, and second means which initiates said predetermined change when said receiver fails to switch between its first and second conditions a predetermined number of times as the elevator car approaches said terminal in said terminal zone.

2. The elevator system of claim 1 including electrical control means for operating the elevator car, and reset means providing a reset signal a predetermined period of time after electrical power is applied to said electrical control means, said reset signal initiating a predetermined sequence for placing the elevator car in service, and wherein the first means includes means which inhibits the generation of said reset signal when the receiver is in its second condition.

3. The elevator system of claim 1 including electrical control means for operating the elevator car, reset means providing a reset signal a predetermined period of time after electrical power is applied to said electrical control means, said reset signal initiating a predetermined sequence for placing the elevator car in service, and wherein the first means includes means which inhibits the generation of said reset signal when the elevator car is outside the terminal zone and the receiver is in its second condition.

4. The elevator system of claim 1 wherein the spaced marker means are fixed in the hatchway adjacent to the terminal floor.

5. The elevator system of claim 4 wherein the terminal zone is defined by hatch switch means fixed in the hatchway adjacent to the start of the spaced marker means, and wherein said hatch switch means is operated by the elevator car.

6. The elevator system of claim 1 wherein the first means of the monitoring means includes memory means which is set to a predetermined state when the elevator car is located outside the terminal zone and the receiver is in its second condition.

7. The elevator system of claim 1 wherein the second means of the monitoring means includes counting means which is pre-set when the elevator car leaves the terminal zone and enabled to count when the elevator car enters the terminal zone, and wherein the switching of the receiver between its conditions operates said counting means.

8. An elevator system, comprising:

a structure having a hatchway and first and second terminal floors, an elevator car mounted for movement in said hatchway, means for detecting overspeed of the elevator car as it approaches the first and second terminal floors in predetermined first and second terminal zones, respectively, adjacent thereto, said means including spaced marker means and detector means mounted for relative movement as the elevator car approaches each terminal floor in the associated terminal zone, said detector means including a source of electromagnetic radiation and a receiver thereof, mounted such that electromagnetic radiation from the source continuously maintains the receiver in a first condition when the elevator car is in a zone intermediate said first and second terminal zones, and with the spaced marker means disposed to operate said receiver between said first condition and a second condition in response to movement of said elevator car in a terminal zone, and monitoring means responsive to the condition of said receiver, including first means which initiates a predetermined change in the operation of said elevator car when the elevator car is located intermediate said first and second terminal zones and said receiver is in its second condition, and second means which initiates said predetermined change when said receiver fails to switch between its first and second conditions a predetermined number of times as the elevator car approaches either terminal in its associated terminal zone.

9. The elevator system of claim 8 including electrical control means for operating the elevator car, and reset means providing a reset signal a predetermined period of time after electrical power is applied to said electrical control means, said reset signal initiating a predetermined sequence for placing the elevator car in service, and wherein the first means includes means which inhibits the generation of said reset signal when the receiver is in its second condition.

10. The elevator system of claim 8 including electrical control means for operating the elevator car, and reset means providing a reset signal a predetermined period of time after electrical power is applied to said electrical control means, said reset signal initiating a predetermined sequence for placing the elevator car in service, and wherein the first means includes means which inhibits the generation of said reset signal when the elevator car is intermediate the first and second terminal zones and the receiver is in its second condition.

11. The elevator system of claim 8 wherein the spaced marker means are fixed in the hatchway adjacent to each of the first and second terminal floors.

12. The elevator system of claim 11 wherein the first and second terminal zones are defined by the first and second hatch switch means fixed in the hatchway adjacent to the start of the spaced marker means adjacent the first and second terminals floors, respectively, and wherein said first and second hatch switch means are operated by the elevator car.

13. The elevator system of claim 8 wherein the first means of the monitoring means includes memory means which is set to a predetermined state when the elevator car is located intermediate the first and second terminal zones and the receiver is in its second condition.

14. The elevator system of claim 8 wherein the second means of the monitoring means includes counting means which is pre-set when the elevator car leaves each terminal zone and is enabled to count when the elevator car enters a terminal zone, and wherein the switching of the receiver between its conditions operates said counting means.

* * * * *